US009932138B2

(12) United States Patent
Kisela

(10) Patent No.: US 9,932,138 B2
(45) **Date of Patent: *Apr. 3, 2018**

(54) BOTTLE WITH INSULATIVE BODY

(71) Applicant: Owens-Brockway Glass Container Inc., Perrysburg, OH (US)

(72) Inventor: David Kisela, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/338,532

(22) Filed: Oct. 31, 2016

(65) Prior Publication Data

US 2017/0043899 A1 Feb. 16, 2017

Related U.S. Application Data

(63) Continuation of application No. 14/831,329, filed on Aug. 20, 2015, now Pat. No. 9,499,293, which is a (Continued)

(51) Int. Cl.
*B65D 23/00* (2006.01)
*B65D 1/02* (2006.01)
(Continued)

(52) U.S. Cl.
CPC ..... *B65D 1/0223* (2013.01); *B65D 23/08* (2013.01); *B65D 23/14* (2013.01); *B65D 81/3837* (2013.01); *B65D 2501/0036* (2013.01)

(58) Field of Classification Search
CPC ..... B65D 2501/0036; B65D 23/08; B65D 23/14; B65D 81/3837; B65D 1/0223
(Continued)

(56) References Cited

U.S. PATENT DOCUMENTS

D64,029 S 2/1924 Pickett
D67,465 S 6/1925 Johnson
(Continued)

FOREIGN PATENT DOCUMENTS

JP 2001048249 A 2/2001
JP 2007197013 A 8/2007

OTHER PUBLICATIONS

PCT Search Report and Written Opinion, Int. Serial No. PCT/US2014/014524, Int. Filing Date: Feb. 4, 2014, Applicant: Owens-Brockway Glass Container Inc., dated Aug. 29, 2014.

*Primary Examiner* — J. Gregory Pickett
*Assistant Examiner* — Elizabeth Volz

(57) ABSTRACT

A bottle extends along a longitudinal axis and includes an insulative body extending axially between a base and a neck of the bottle. The body includes radially outwardly facing first surfaces spaced axially apart from one another, and a radially outwardly facing second surface radially smaller than, and located axially between, the first surfaces. The body also includes a plurality of projections projecting from the second surface and collectively establishing a radially outwardly facing third surface radially larger than the second surface, and parting line bridges projecting radially outwardly from the second surface, diametrically opposed to one another, and extending axially between the first surfaces. A label is carried by the body over at least a portion of the third surface, wherein a continuous insulation volume is established between the label and the second surface, and extends continuously over more than 90 angular degrees around the bottle.

20 Claims, 9 Drawing Sheets

Related U.S. Application Data continuation of application No. 13/761,598, filed on Feb. 7, 2013, now Pat. No. 9,150,331.

(51) Int. Cl.

| | |
|---|---|
| ***B65D 23/08*** | (2006.01) |
| ***B65D 81/38*** | (2006.01) |
| ***B65D 23/14*** | (2006.01) |

(58) Field of Classification Search

USPC ..... 220/675; 215/382, 384, 40

See application file for complete search history.

(56) References Cited

U.S. PATENT DOCUMENTS

| | | | | |
|---|---|---|---|---|
| D95,589 | S | 5/1935 | Kessler | |
| D124,861 | S | 1/1941 | Leach, Jr. | |
| D130,341 | S | 11/1941 | Nelson | |
| D356,953 | S | 4/1995 | Nakamura | |
| 5,704,504 | A | 1/1998 | Bueno | |
| D391,858 | S | 3/1998 | Dolan et al. | |
| D393,210 | S | 4/1998 | Ewing, Jr. | |
| 5,820,016 | A | 10/1998 | Stropkay | |
| D411,442 | S | 6/1999 | Edson et al. | |
| D412,119 | S | 7/1999 | Guertin | |
| 6,041,952 | A | 3/2000 | Martin | |
| 6,230,912 | B1 | 5/2001 | Rashid | |
| 6,253,995 | B1 | 7/2001 | Blok et al. | |
| 6,296,131 | B2 * | 10/2001 | Rashid | B65D 1/0223 215/382 |
| 6,308,846 | B1 | 10/2001 | Muller | |
| D454,503 | S | 3/2002 | Riddick, III et al. | |
| 6,497,333 | B1 | 12/2002 | Ellis et al. | |
| 6,550,627 | B2 | 4/2003 | Elich et al. | |
| 6,827,228 | B2 | 12/2004 | Headen et al. | |
| 6,857,531 | B2 | 2/2005 | Slat et al. | |
| 6,929,139 | B2 | 8/2005 | Darr | |
| 6,983,858 | B2 | 1/2006 | Slat et al. | |
| 7,051,890 | B2 | 5/2006 | Onoda et al. | |
| 7,247,471 | B2 * | 7/2007 | Kadar | C12M 23/08 215/382 |
| 7,344,038 | B2 | 3/2008 | Elansary | |
| D567,663 | S | 4/2008 | Kinmont et al. | |
| D572,137 | S | 7/2008 | Dinnel et al. | |
| 7,799,394 | B2 | 9/2010 | Toms | |
| D631,753 | S | 2/2011 | Russell et al. | |
| D652,733 | S | 1/2012 | Oommen et al. | |
| 9,150,331 | B2 * | 10/2015 | Kisela | B65D 1/0223 |
| 9,499,293 | B2 * | 11/2016 | Kisela | B65D 1/0223 |
| 2002/0020687 | A1 | 2/2002 | Sasaki et al. | |
| 2003/0010744 | A1 * | 1/2003 | Ma | A61H 15/0092 215/382 |
| 2005/0274686 | A1 | 12/2005 | Elansary | |
| 2005/0279728 | A1 | 12/2005 | Finlay et al. | |
| 2007/0175906 | A1 | 4/2007 | Caladrino | |
| 2008/0050478 | A1 | 2/2008 | Kinmont et al. | |
| 2008/0110853 | A1 | 5/2008 | Toms | |
| 2008/0110854 | A1 | 5/2008 | Kelly | |
| 2008/0223816 | A1 | 9/2008 | Darr et al. | |
| 2010/0032405 | A1 | 2/2010 | Ozawa et al. | |
| 2010/0264107 | A1 | 10/2010 | Lonsway et al. | |
| 2012/0000878 | A1 | 1/2012 | Reisig | |
| 2012/0091124 | A1 | 4/2012 | Frisch et al. | |

* cited by examiner

BOTTLE WITH INSULATIVE BODY

The present disclosure is directed to containers and, more particularly, to bottles.

BACKGROUND AND SUMMARY OF THE DISCLOSURE

Bottles typically include a body, a shoulder, a neck, and a neck finish. U.S. Patent Application Publication 2012/0000878 illustrates an example glass bottle of this general type. Such bottles may be produced using a blow-and-blow manufacturing process or a press-and-blow manufacturing process, and typically have substantially uniform wall thicknesses. Moreover, longneck bottles are popular in the beverage packaging industry, particularly for packaging beer. U.S. Patent Application Publication 2010/0264107 illustrates example longneck bottles having necks with internal ribs produced by forming external ribs on necks of parisons and pushing the external ribs into the necks during blowing of the parisons into the bottles.

A general object of the present disclosure, in accordance with one aspect of the disclosure, is to provide a bottle that includes an insulative body for reduced heat transfer from a user's hand to improve insulation performance of the bottle.

The present disclosure embodies a number of aspects that can be implemented separately from or in combination with each other.

A bottle in accordance with one aspect of the disclosure extends along a longitudinal axis and includes a base, a neck, and an insulative body extending axially between the base and the neck. The body includes radially outwardly facing first surfaces spaced axially apart from one another, and a radially outwardly facing second surface radially smaller than, and located axially between, the first surfaces. The body also includes a plurality of projections projecting from the second surface and collectively establishing a radially outwardly facing third surface radially larger than the second surface, and parting line bridges projecting radially outwardly from the second surface, diametrically opposed to one another, and extending axially between the first surfaces. A label is carried by the body over at least a portion of the third surface, wherein a continuous insulation volume is established between the label and the second surface, and extends continuously over more than 90 angular degrees around the bottle.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
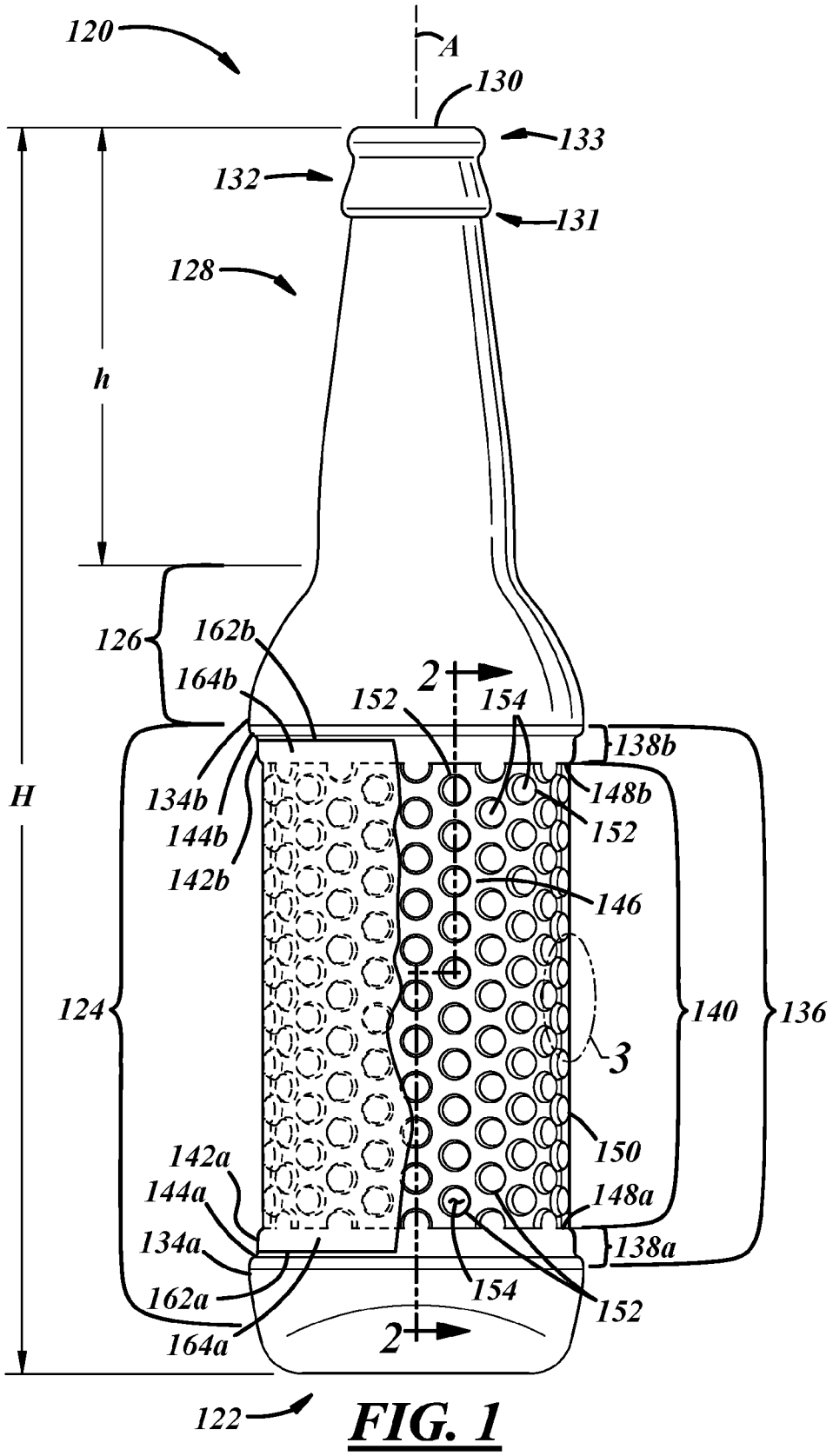
FIG. 1 is an elevational view of a bottle having an insulative body, in accordance with an illustrative embodiment of the present disclosure.

FIG. 1 illustrates a bottle 120 extending along a longitudinal central axis A in accordance with one illustrative embodiment of the present disclosure. The bottle 120 may include a closed base 122, an insulative body 124 extending longitudinally from the base 122 at one end of the body 124, a shoulder 126 extending longitudinally and radially inwardly from another end of the body 124, and a neck 128 extending longitudinally from the shoulder 126 terminating in a lip 130. The bottle 120 also includes a neck finish 132 axially spaced from the shoulder 126 and terminating the neck 128, and including one or more features for attachment of a desired closure (not shown). In the illustrated example, the neck finish 132 may be a crown type of finish that may include a capping flange 131, a crimp bead or crown 133 for engagement with a crimping type of closure (not shown), and the lip 130. In another example, although not illustrated, the neck finish 132 may be a threaded type of finish that may include a capping flange and one or more threads or thread segments to cooperate with corresponding thread segments on a threaded type of closure (not shown). In other examples, the neck finish 132 may include any other suitable closure attachment features. The bottle 120 may be used for containing, for example, a beverage, for instance, beer, wine, spirits, soda, or the like, or any other any flowable product.

The body 124 extends axially between the base 122 and the neck 128, and may include radially outwardly facing first surfaces 134*a,b* spaced axially apart from one another and a radially recessed portion 136 extending axially between the radially outwardly facing first surfaces 134*a,b*. The first surfaces 134*a* and 134*b* may or may not be identical in radial size and may be generally circular or elliptical in cross-section perpendicular to the axis A.

The radially recessed portion 136 may include a base label surface or second surface 146 axially between and smaller than the first surfaces 134*a,b*. The recessed portion 136 also may include stepped portions 138*a,b* extending axially and radially inwardly from adjacent corresponding radially outwardly facing first surfaces 134*a,b*, and an insulative portion 140 extending axially between the radially outwardly facing first surfaces 134*a,b* and, more particularly, axially between the stepped portions 138*a,b*. In accordance with this embodiment, the insulative portion 140 of the radially recessed portion 136 may include the second surface 146 and a radially outwardly facing third surface 150 axially between the radially outwardly facing first surfaces 134*a,b*. The third surface 150 may be radially larger than the second surface 146 and established collectively by a plurality of projections 152 that project radially outwardly from the second surface 146. More particularly, the third surface 150 may be established collectively by radially outwardly facing projection surfaces 154 of the projections 152. The third surface 150 may be circular or elliptical in cross-section normal to the axis A.

The recessed portion 136 also may include radially outwardly facing fourth surfaces 142*a,b* axially between and radially smaller than the first surfaces 134*a,b* but radially larger than the second surface 146. The recessed portion 136 further may include axially facing shoulders 144*a,b* between the first and fourth surfaces 134*a,b*, and 142*a,b*. The radially outwardly facing second surface 146 may extend axially between the radially outwardly facing fourth surfaces 142*a,b* and may be radially smaller than the fourth surfaces 142*a,b*. The recessed portion 136 additionally may include axially facing shoulders 148*a,b* between the second surface 146 and the fourth surfaces 142*a,b*. The fourth surfaces 142*a,b* may be radially substantially the same size as the third surface 150 and/or axially adjacent individual surfaces 154. As used herein, the term "substantially" includes within manufacturing tolerances well known to those of ordinary skill in the art. In other embodiments, the third surface 150 and/or axially adjacent individual surfaces 154 may be smaller than the fourth surfaces 142*a,b* but larger than the second surface 146, or may be larger than the fourth surfaces 142*a,b* but smaller than the first surfaces 134*a,b*.

The first and fourth surfaces 134*a,b*, 142*a,b* and stepped portions 138*a,b* may be circumferentially continuous and, for example, in cross section perpendicular to the axis A, may be circular or elliptical. Likewise, except for the projections 152, the second surface 146 may be circumferentially continuous and, for example, in cross section perpendicular to the axis A, may be circular or elliptical.

In this embodiment, the projections 152 may be axially and circumferentially spaced apart from one another in an array of straight circumferentially spaced and axially offset columns, wherein individual projections of adjacent columns may be axially staggered with respect to one another. The projection array may include at least eight rows and at least twenty columns for at least 160 individual projections 152.

Figure 2:
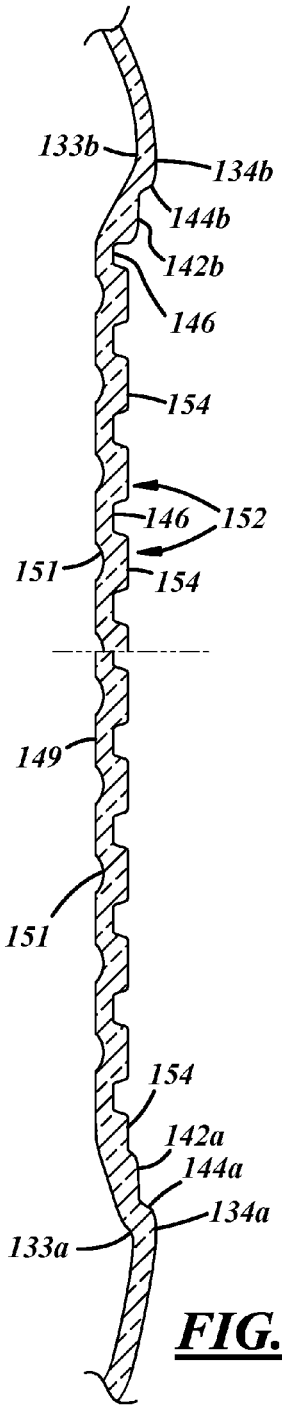
FIG. 2 is a longitudinal cross-sectional view of the bottle of FIG. 1, taken along line 2-2 of FIG. 1.

Also in this embodiment, the projections 152 may be nubs. In the illustrated example, the nubs may be frusto-conical. More specifically, the outer projection surfaces 154 may have a circular shape when viewed from a radial direction, and the projections 152 may have a trapezoidal shape in longitudinal cross section (FIG. 2). But, in other examples, the nubs may be semi-spherical, cylindrical, conical, and/or any other suitable shape(s).

With reference to FIG. 2, the wall of the container body 124 may include plurality of reliefs or dimples 151 in, and that extend radially outwardly from, a radially inner surface 149 of the body 124. The dimples 151 correspond to the projections 152. More particularly, the radially inner surface 149 may be part of the insulative portion 140. The radially inner surface 149 may be smaller than radially inner surfaces 133*a*, 133*b* of the body 124 that correspond to the outer surfaces 134*a*, 134*b* on either axial end of the portion 140.

Figure 3:
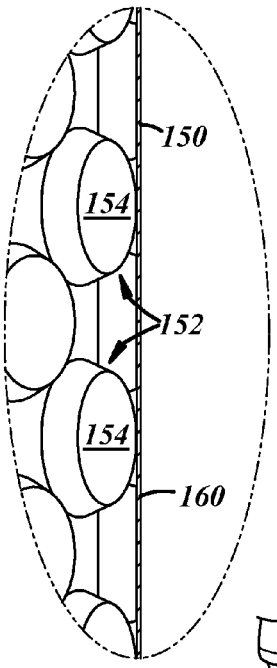
FIG. 3 is an enlarged fragmentary portion of the bottle of FIG. 1, taken from ellipse 3 of FIG. 1.

With reference to FIG. 3, some or all of the projections 152 may include radially outwardly facing projection surfaces 154. In the illustrated example, the surfaces 154 may appear flat, but actually may be at least one of flat or faceted, crowned, semi-spherical, or part of a surface of revolution 360 angular degrees around the bottle 120.

Figure 4:
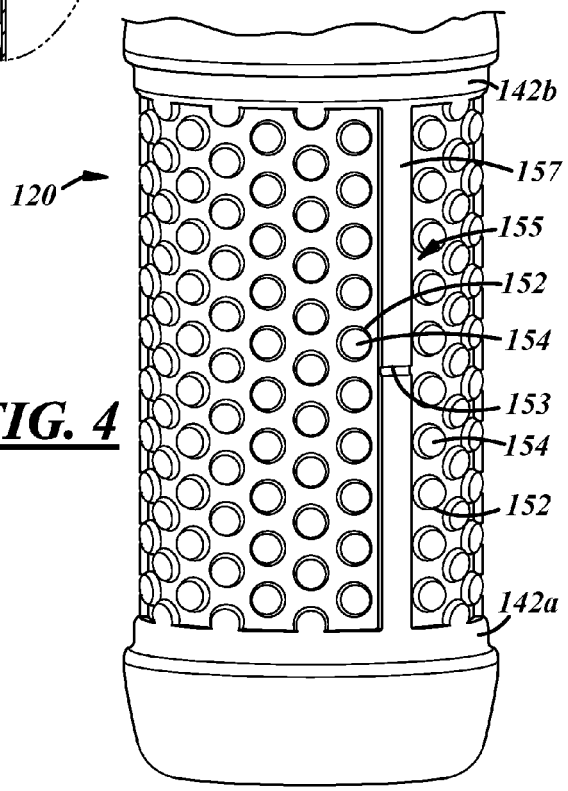
FIG. 4 is a fragmentary portion of the bottle of FIG. 1, rotated circumferentially to illustrate a bridge portion of the insulative body.

As shown in FIG. 4, the body 124 may include parting line bridges 155 that may be diametrically opposed and project radially outwardly from the second surface 146. The parting line bridges 155 may axially intersect the projections 152 and may have outer surfaces 157 coincident with the outer surfaces 154 of the projections 152 and the radially outwardly facing fourth surfaces 142*a,b*.

Referring to FIG. 1, the bottle 120 may be part of a package that may include a separate label 160 applied to the bottle 120 and, more specifically, carried by the body 124. In one embodiment, the label 160 may be generally rectangular with transverse ends (not shown), and may be wrapped circumferentially around the body 124 such that the transverse ends overlap. In another embodiment, the label 160 may be circumferentially continuous and of generally hollow cylindrical shape, and the label 160 may be placed axially over the bottle 120 and shrink fit around the body 124. The label 160 may be composed of any suitable material but, preferably, may be composed of paper, plastic film, or of any other suitable flaccid material.

In any case, the label 160 may include axial ends 162*a,b* and axial margins 164*a,b* adjacent the axial ends 162*a,b*. The axial ends 162*a,b* may be carried on the fourth surfaces 142*a,b*, for example, in circumferentially continuous surface contact therewith. In fact, the axial margins 164*a,b* may be adhered to the fourth surfaces 142*a,b* using pressure-sensitive adhesive carried by the label 160 or any other suitable adhesive, and the axial margins 164*a,b* may be sealed to the bottle 120 circumferentially continuously to provide an air-tight volume of air between the label 160 and the bottle 120.

Also, or instead, the label 160 may be carried by at least some of the projections 152. For example, corresponding portions of the label 160 may be adhered to the radially outwardly facing surfaces 154 of the projections using pressure-sensitive adhesive carried by the label 160 or any other suitable adhesive. The surface contact between the label 160 and the third surface 150 is characterized by multiple discrete contact areas such that there is no continuous path of surface contact between the label 160 and the third surface 150 for 360 angular degrees around the bottle.

To the contrary, the contact between the label 160 and the corresponding portion of the body 124 is circumferentially and axially interrupted by circumferential and axial spaces between the projections 152. In other words, radial, axial, and circumferential space establishes one or more insulation volumes between the label 160 and the second surface 146 that extend continuously over more than 90 angular degrees around the container 120 about the axis A. The insulation volumes may include two insulation volumes that extend about 180 degrees around the container 120 about the axis A, except for the bridges 155. Accordingly, one or more large volumes of air may be defined between the label 160 and the body 124 and may be circumferentially continuous for more than 90 degrees, axially between the shoulders 148*a,b*. In one embodiment, the two insulation volumes may be connected, for example, via reliefs 153 extending circumferentially across and radially into one or both of the bridges 155, or in any other suitable manner. Accordingly, in contrast to prior approaches where a plurality of individual discrete pockets are established between a label and a bottle, here a much larger volume of air may be defined between the label 160 and the bottle 120 for improved insulative effect.

In fact, according to computer aided design analysis and calculations, the volume of air between the label 160 and bottle 120 is on the order of 0.031 cubic inches per square inch of corresponding label area. The calculated total volume includes those volumes under or radially inward of the label surface area that are axially between the steps 142*a*, 142*b* and circumferentially between the bridges 155.

The bottle 120 may be of any suitable shape and size. In just one of many potential examples, the bottle 120 may be a longneck bottle having an overall height H, and the neck 128 (including neck finish 132) having a neck height h. For purposes of the present disclosure, the term "longneck bottle" is defined as a bottle in which the height h of the bottle neck is at least 25% of the overall bottle height H. In illustrative embodiments of the present disclosure, the neck height h is in the range of 33% to 40% of bottle height H. The heights H, h may be measured to the sealing surface or lip 130 that axially terminates the neck 128 and neck finish 132. Also, the bottle 120 may be a narrow neck bottle, having a thread diameter (so-called "T" dimension) or a crown diameter (so-called "A" dimension) not more than 38 mm. The bottle 120 is of one-piece integrally formed construction, for, example, of glass, ceramic, metal, or plastic construction. (The term "integrally formed construction" does not exclude one-piece integrally molded layered glass constructions of the type disclosed for example in U.S. Pat. No. 4,740,401, or one-piece glass or metal bottles to which other structure is added after the bottle-forming operation.)

The bottle 120 may be composed of any suitable material, for example, glass, plastic, or metal. Glass bottles can be fabricated by press-and-blow and/or blow-and-blow manufacturing operations, or by any other suitable technique(s). Plastic bottles can be produced by injection and/or blow molding techniques. Metal bottles can be produced by bending, rolling, welding, or any other suitable forming or joining techniques.

Figure 5:
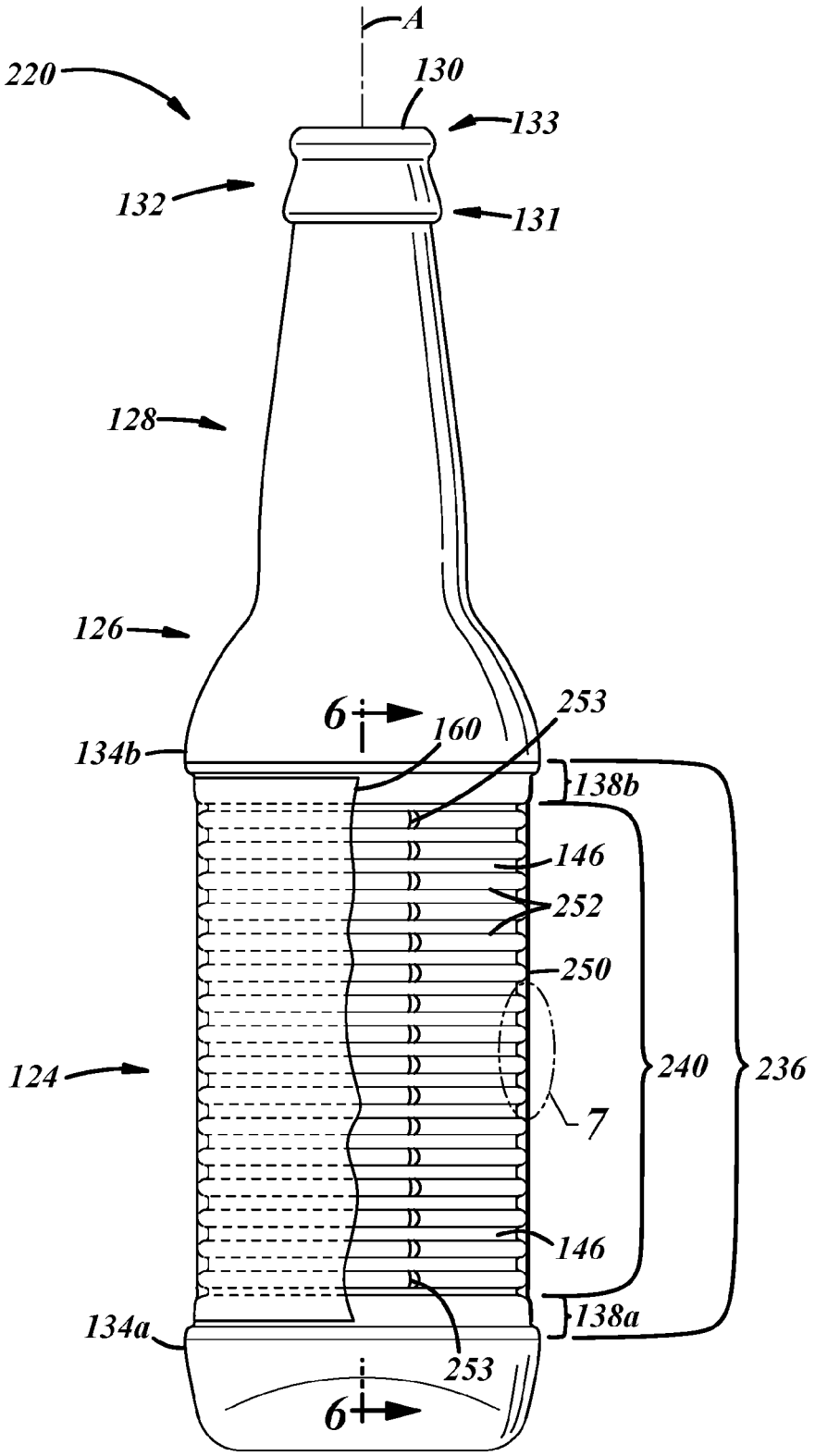
FIG. 5 is an elevational view of a bottle having an insulative body, in accordance with another illustrative embodiment of the present disclosure.
Figure 6:
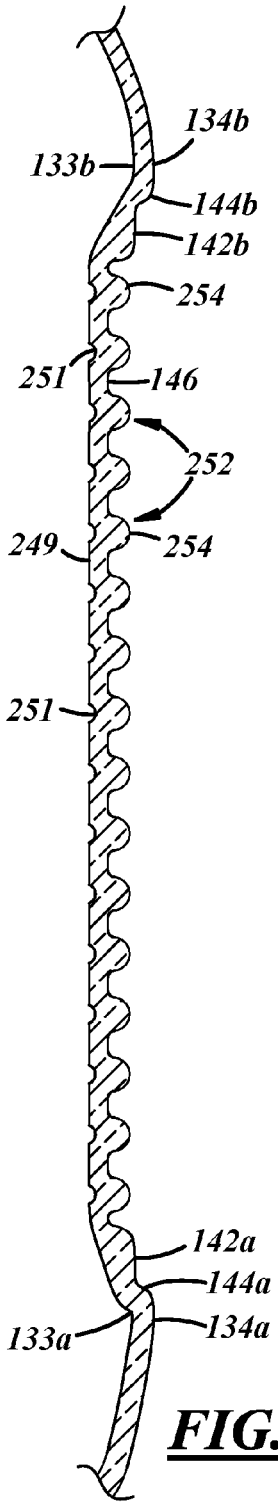
FIG. 6 is a longitudinal cross-sectional view of the bottle of FIG. 5, taken along line 6-6 of FIG. 5.
Figure 7:
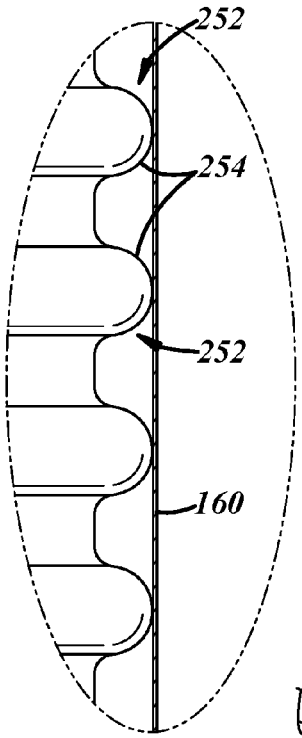
FIG. 7 is an enlarged fragmentary portion of the bottle of FIG. 5, taken from ellipse 7 of FIG. 5.

FIGS. 5 through 7 illustrate another illustrative embodiment of a bottle 220. This embodiment is similar in many respects to the embodiment of FIGS. 1 through 4 and like numerals between the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 5, the bottle 220 may be substantially identical to the bottle 120 of FIGS. 1 through 4, except for a different insulative body 224. In accordance with this embodiment, the body 224 may include a different radially recessed portion 236 including a different insulative portion 240. The body 224 also may include a plurality of annular ribs 252 projecting from the radially outwardly facing primary surface 146 and collectively establishing a radially outwardly facing third surface 250 radially larger than the radially outwardly facing second surface 146 and radially smaller than the radially outwardly facing first surfaces 134*a,b*. The third surface 250 and/or axially adjacent individual surfaces 254 may be radially substantially the same size as the fourth surfaces 142*a,b*. In other embodiments, the third surface 250 and/or axially adjacent individual surfaces 254 may be smaller than the fourth surfaces 142*a,b* but larger than the second surface 146, or may be larger than the fourth surfaces 142*a,b* but smaller than the first surfaces 134*a,b*.

The ribs 252 are annular and axially spaced apart, with annular spaces therebetween. The ribs 252 may be arranged in any suitable quantity of rows and, as illustrated, may include at least twelve spaced apart rows. At least some of the ribs 252 may include reliefs 253 that circumferentially interrupt the ribs 252 to allow communication of air between the annular spaces established by the ribs 252.

With reference to FIG. 6, the wall of the container body 224 may include plurality of annular reliefs 251 in, and that extend radially outwardly from, a radially inner surface 249 of the body 224. The reliefs 251 correspond to the projections 252. More particularly, the radially inner surface 249 may be part of the insulative portion 240. The radially inner surface 249 may be smaller than radially inner surfaces 133*a*, 133*b* of the body 224 that correspond to the outer surfaces 134*a,b* on either axial end of the portion 240.

With reference to FIG. 7, some or all of the ribs 252 may include radially outwardly facing surfaces 254. In the illustrated example, the surfaces 154 may be semi-spherical, but in other examples, the outer surfaces 254 may be faceted, or of any other suitable configuration.

Figure 8:
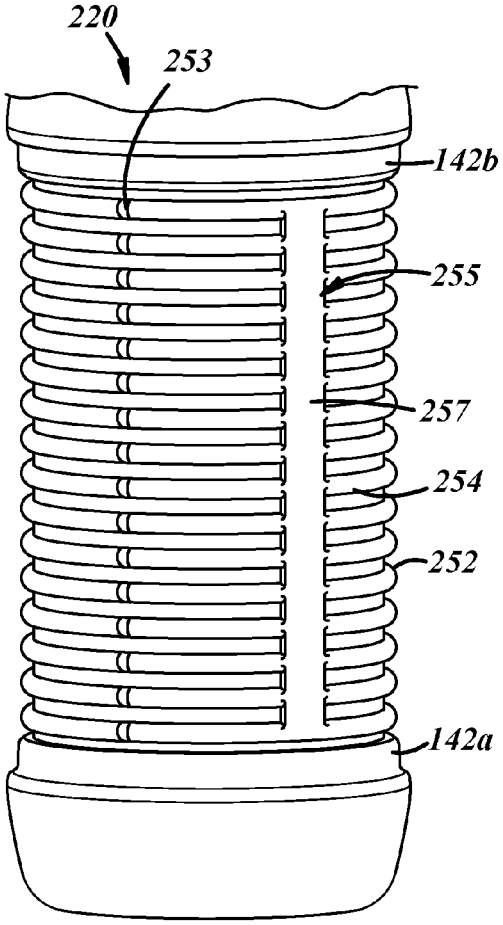
FIG. 8 is a fragmentary portion of the bottle of FIG. 5, rotated circumferentially to illustrate a bridge portion of the insulative body.

As shown in FIG. 8, the body 224 may include parting line bridges 255 that may be diametrically opposed and project radially outwardly from the second surface 146. The parting line bridges 255 may axially intersect the projections 252 and may have outer surfaces 257 coincident with the outer surfaces 254 of the projections 252 and with the radially outwardly facing fourth surfaces 142*a,b*.

Referring to FIG. 5, the bottle 220 also may be part of a package including the label 160. Radial, axial, and circumferential spaces may establish insulating volumes between the label 160 and the second surface 146 and may extend continuously over more than 90 angular degrees around the bottle 220. In the embodiment including the reliefs 253, one or more large volumes of air may be defined between the label 160 and the body 224 and may be circumferentially continuous, at between the shoulders 148*a,b* and at least circumferentially between the parting line bridges if not completely around the container 220 about the axis A. Accordingly, in contrast to prior approaches where a plurality of individual discrete pockets are established between a label and a bottle, here a much larger volume of air may be defined between the label 160 and the bottle 220 for improved insulative effect.

In fact, according to computer aided design analysis and calculations, the volume of air between the label 160 and bottle 220 is on the order of 0.025 cubic inches per square inch of corresponding label area. The calculated total volume includes those volumes under or radially inward of the label surface area that are axially between the steps 142*a*, 142*b* and circumferentially between the bridges 255.

Accordingly, the volume of air between the label 160 and the bottles 120 or 220 is preferably at least 0.020 cubic inches per square inch of corresponding label area and, more preferably, at least 0.025 cubic inches per square inch of corresponding label area, and most preferably, at least 0.030 cubic inches per square inch of corresponding label area.

Figure 9:
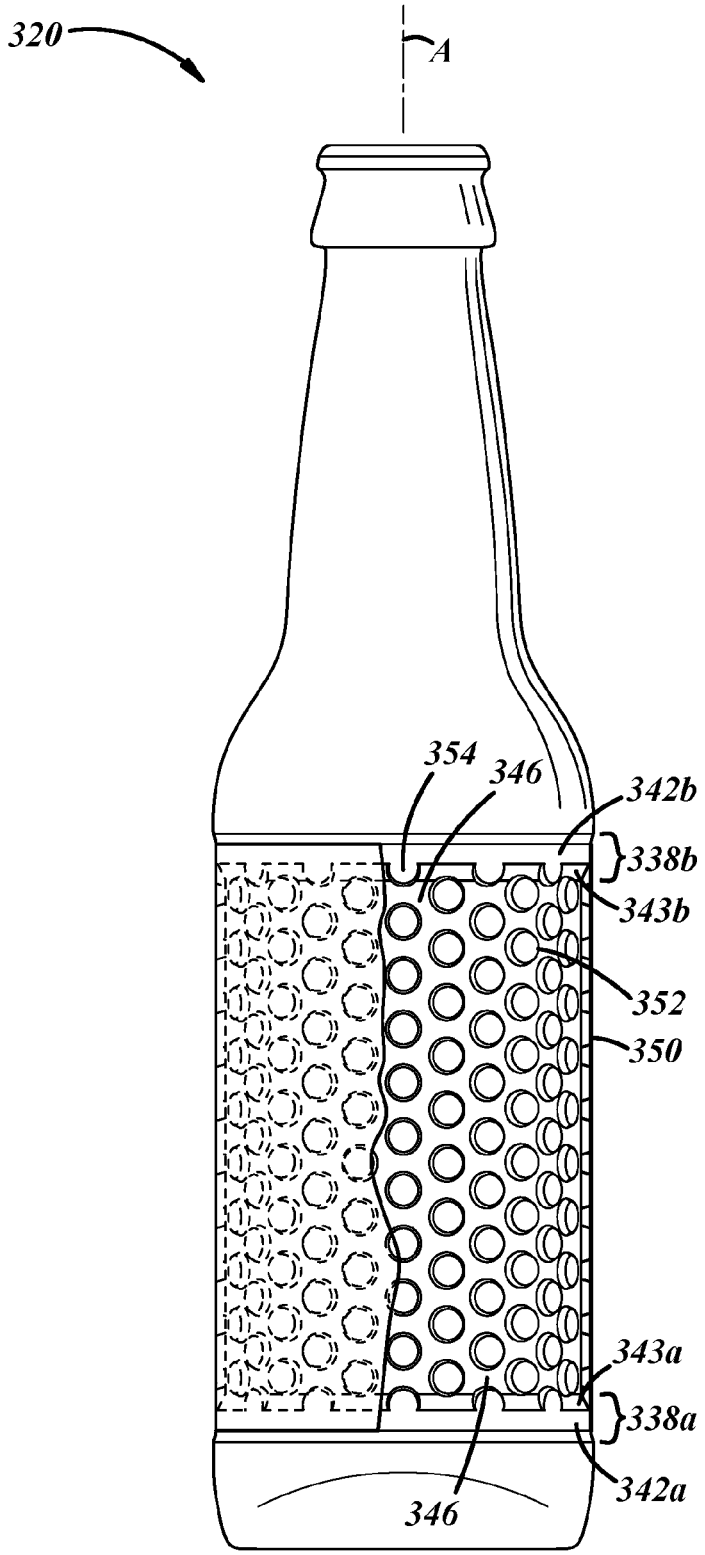
FIG. 9 is an elevational view of a bottle having an insulative body, in accordance with a further illustrative embodiment of the present disclosure.

FIG. 9 illustrates another illustrative embodiment of a bottle 320. This embodiment is similar in many respects to the embodiment of FIGS. 1 through 8 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The bottle 320 is substantially similar to the bottle 120 of FIGS. 1-4, except for stepped portions 338*a,b*. In this embodiment, the stepped portions 338*a,b* are stepped radially inwardly to a lesser extent compared to the bottle 120 of FIGS. 1-4, and include beveled portions 343*a,b* that transition from fourth surfaces 342*a,b* to a second surface 346 and that may carry at least portions of nubs 352 thereon. At least some axially outermost nubs 352 may be intersected by the fourth surfaces 342*a,b* as illustrated, and at least some nubs 352 axially inward thereof may be intersected by a transition between the fourth surfaces 342*a,b* and the second surface 346. Also, as illustrated, the outer surfaces 354 of the nubs 352 and, thus, a third surface 350, may be smaller in radial dimension than the fourth surfaces 342*a,b*.

Figure 10:
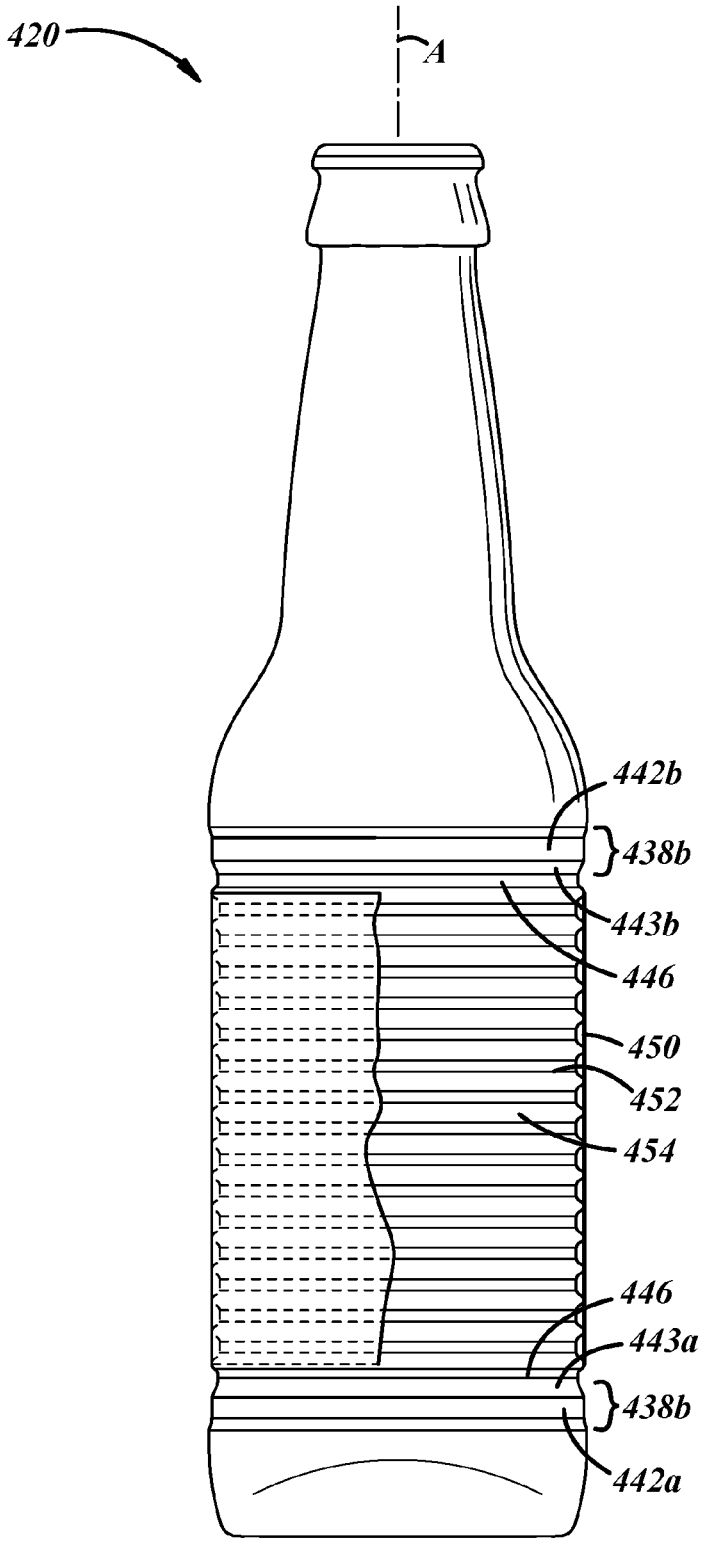
FIG. 10 is an elevational view of a bottle having an insulative body, in accordance with an additional illustrative embodiment of the present disclosure.

FIG. 10 illustrates another illustrative embodiment of a bottle 420. This embodiment is similar in many respects to the embodiment of FIGS. 1 through 9 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The bottle 420 is substantially similar to the bottle 220 of FIGS. 5-8, except for stepped portions 438*a,b*. In this embodiment, like the previous embodiment, the stepped portions 438*a,b* are stepped radially inwardly to a lesser extent compared to the bottle 220 of FIGS. 5-8, and include beveled portions 443*a,b* that transition from fourth surfaces 442*a,b* to a second surface 446. Also, as illustrated, the outer surfaces 454 of the nubs 452 and, thus, a third surface 450, may be smaller in radial dimension than the fourth surfaces 442*a,b*.

Figure 11:
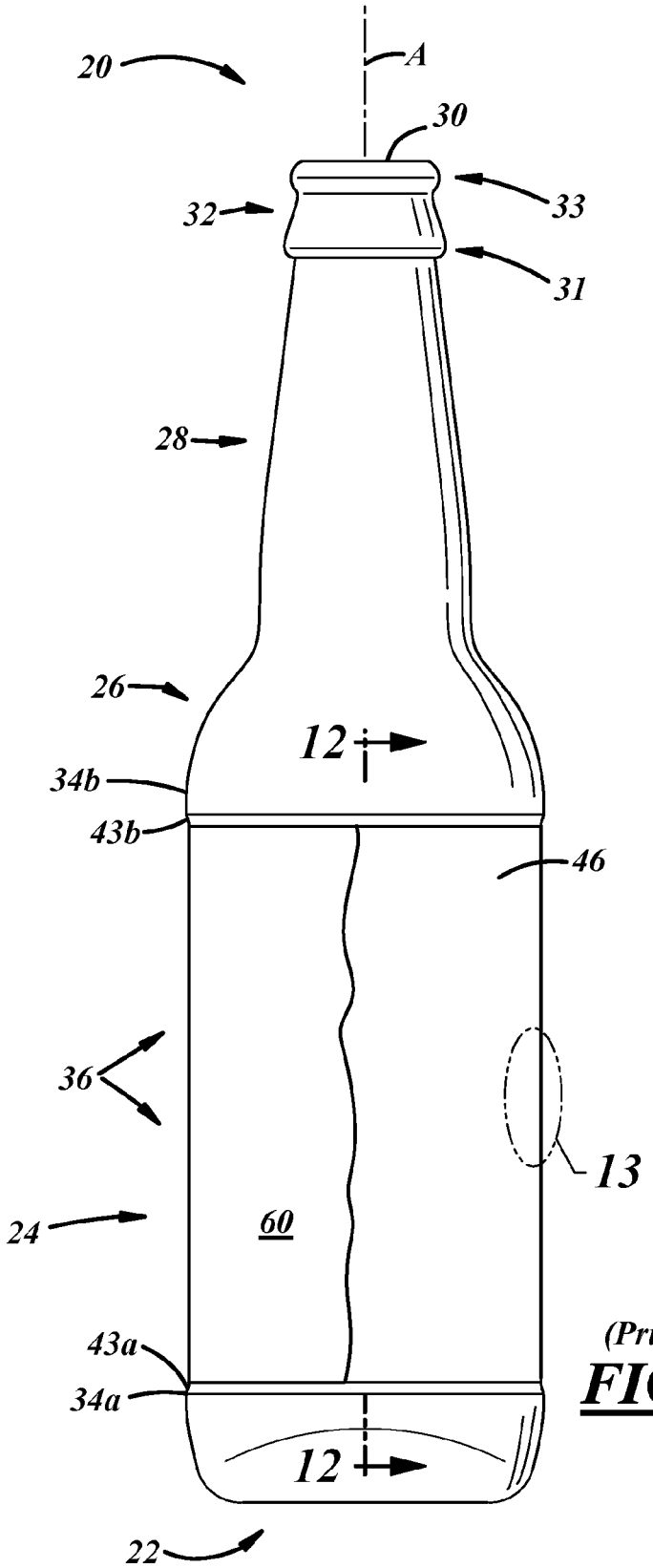
(Prior Art) FIG. 11
FIG. 11 is an elevational view of a conventional bottle in accordance with the prior art.
Figure 12:
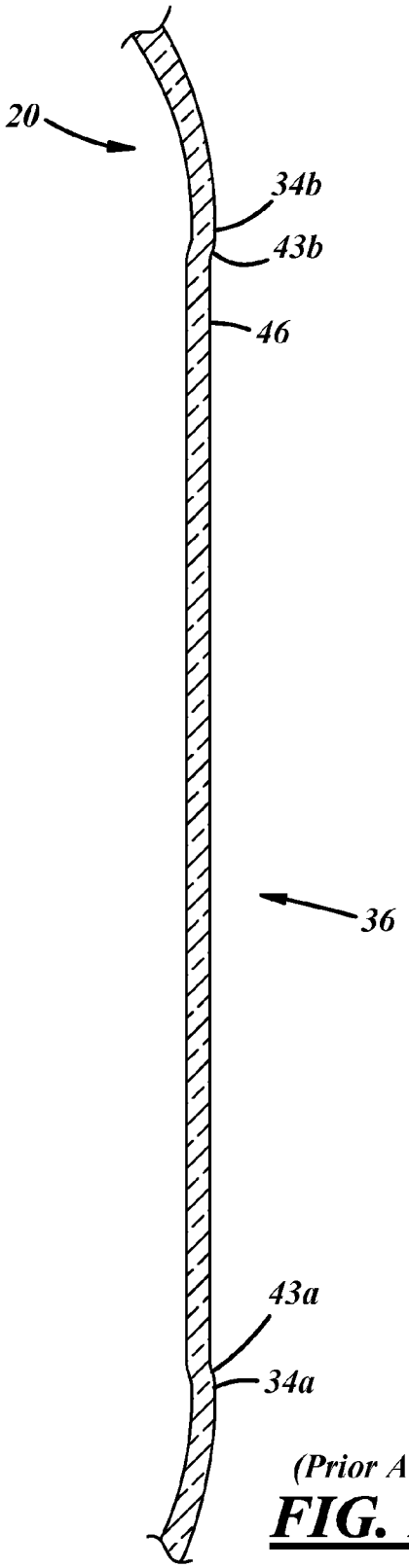
(Prior Art) FIG. 12
FIG. 12 is a longitudinal cross-sectional view of the bottle of FIG. 11, taken along line 12-12 of FIG. 11.
Figure 13:
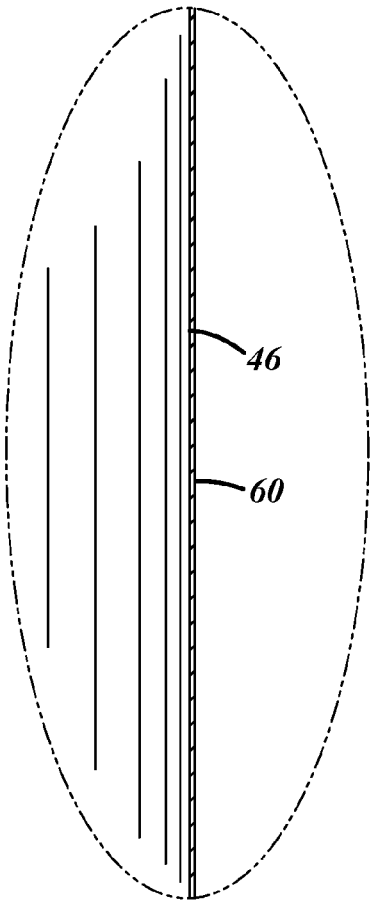
(Prior Art) FIG. 13
FIG. 13 is an enlarged fragmentary portion of the bottle of FIG. 11, taken from ellipse 13 of FIG. 11.

FIGS. 11 through 13 illustrate a conventional bottle 20, in accordance with the prior art, which shares some aspects with the embodiments of FIGS. 1 through 10 and like numerals between the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 11, the prior art bottle 20 extends along a longitudinal central axis A and includes a closed base 22, a body 24 extending longitudinally from the base 22, a shoulder 26 extending longitudinally and radially inwardly from the body 24, and a neck 28 extending longitudinally from the shoulder 26 to and including a lip 30. The bottle 20 also includes a neck finish 32 axially spaced from the shoulder 26 and terminating the neck 28, and including a capping flange 31 and a crown 33.

Also with reference to FIG. 12, the bottle 20 has radially outwardly facing first surfaces 34*a,b*, and a radially recessed portion 36 extending therebetween. The recessed portion 36 includes stepped portions 43*a,b* extending axially and radially inwardly from adjacent corresponding radially outwardly facing first surfaces 34*a,b*, and a radially outwardly facing base label surface 46 extending axially between the stepped portions 43*a,b*. Accordingly, the bottle 20 lacks the insulative features disclosed herein.

Referring to FIG. 13, a label 60 may be carried by the label surface 46 in any suitable manner. The label 60 is in complete cylindrically continuous contact with a corresponding portion of the body 24.

Figure 14:
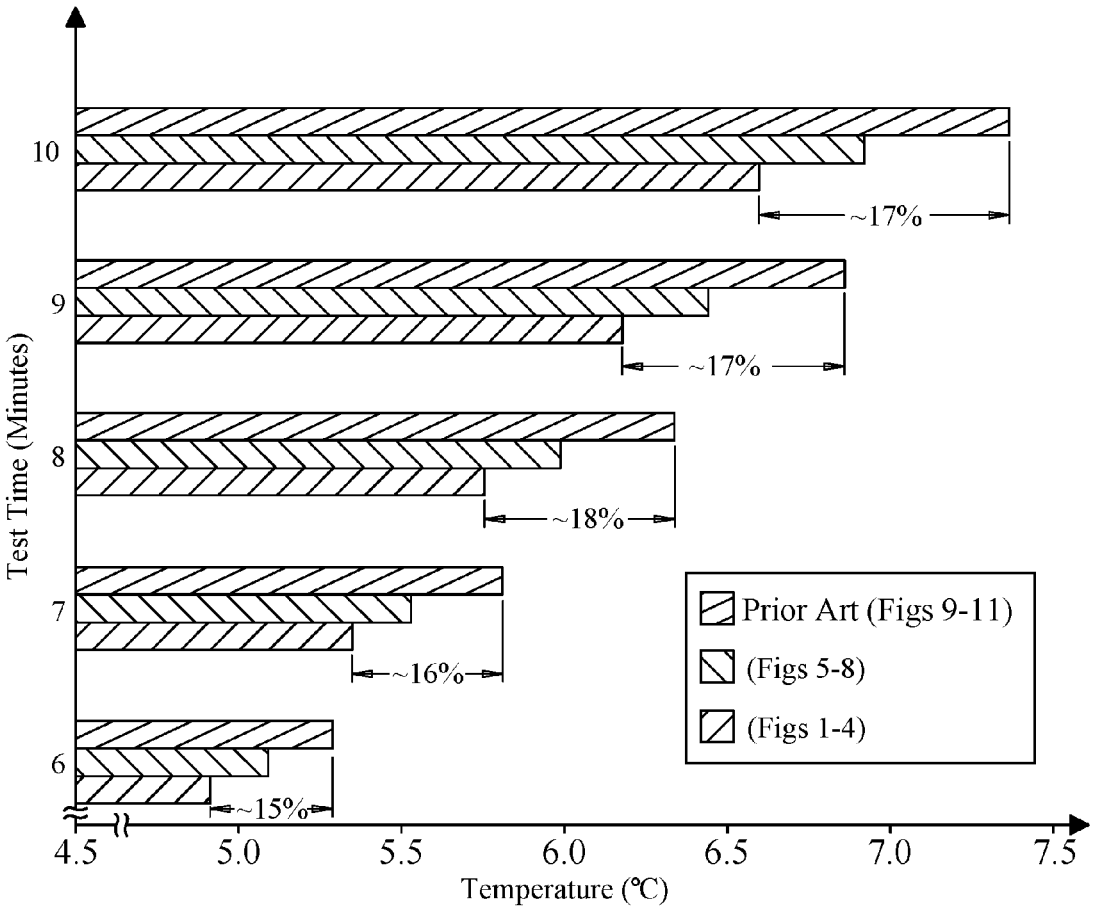
FIG. 14 is a horizontal bar chart demonstrating insulation performance test results from the bottles of FIGS. 1, 5, and 9.

With reference to FIG. 14, to evaluate the improvement of the insulative properties that can be obtained in accordance with the technical teachings herein, several specimens were fabricated for testing. FIG. 14 graphically illustrates results from evaluating temperature increase over time for the two example embodiments of bottles 120, 220 described herein against the prior art bottle 20 described herein under identical test conditions.

More specifically, a control specimen, according to the conventional bottle 20 of FIGS. 11-13, was fabricated and is represented by the top bar in the legend of FIG. 14, a second specimen according to FIGS. 5-8 was fabricated and is represented by the middle bar in the legend, and a third specimen according to FIGS. 1-4 was fabricated and is represented by the bottom bar in the legend.

A test apparatus (not shown) included a thermal chamber for heating a bottle, a heater in communication with the thermal chamber, a bottle chamber carried in the thermal chamber and adapted to receive a bottle, a thermocouple array to measure temperature of the liquid in the bottle, a cooling reservoir to cool and hold liquid and including one or more thermocouples, pumps and conduit to convey fluid to and from the bottle, and electronics and a computer in communication with the aforementioned devices to control the devices and having suitable test software loaded thereto. For each specimen, the following operational steps were carried out.

1. Ensure that the bottle is empty and the cooling reservoir is ready to start.
2. Place the bottle in the bottle chamber of the test apparatus.
3. Lower the thermocouple array into the bottle.
4. Ensure that the bath is colder than 0° C. so that the test can begin at no more than 3° C.
5. Make sure the cold liquid pump is operational.
6. Using the computer, enter applicable information for the test in a test header.
7. Choose the appropriate test profile using the computer.
8. Press a GO button to initiate the test. At this point, the pump operates to fill the bottle with the cold liquid, for example, 95% water and 5% isopropanol, and the cold liquid is at a starting temperature of three degrees Celsius in the bottle. The heater blows warm air over the external surfaces of the bottle, and the temperature of the liquid in each bottle is measured. The bottle liquid measurements are plotted in FIG. 14 at intervals of 6, 7, 8, 9, and 10 minutes after the test is initiated.

At each of the intervals, the differences in temperature between the control and each of the presently disclosed bottle specimens can be seen in FIG. 14. In particular, the differences in temperatures are greatest between the control and the bottle specimen corresponding to FIGS. 1-4. Accordingly, it can be seen from FIG. 14, that the embodiment illustrated in FIGS. 1-4 provides a 15-18% improvement in insulative performance over the prior art.

There thus has been disclosed a bottle that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A bottle extending along a longitudinal axis and that includes, a base;

a neck; and an insulative body extending axially between the base and the neck, and including:

radially outwardly facing first surfaces spaced axially apart from one another;

a radially outwardly facing second surface radially smaller than, and located axially between, the first surfaces;

a plurality of projections projecting from the second surface and collectively establishing a radially outwardly facing third surface radially larger than the second surface; and parting line bridges projecting radially outwardly from the second surface, diametrically opposed to one another, and extending axially between the first surfaces; and a label carried by the body over at least a portion of the third surface, wherein a continuous insulation volume is established between the label and the second surface, and extends continuously over more than 90 angular degrees around the bottle, wherein surface contact between the label and the third surface is characterized by multiple discrete contact areas such that there is no continuous path of surface contact between the label and third surface 360 angular degrees around the bottle.

2. The bottle set forth in claim 1, wherein the insulation volume extends continuously about 180 angular degrees around the bottle except for the parting line bridges.

3. The bottle set forth in claim 1, wherein the label has axial margins sealed to the bottle so that the continuous insulation volume is air-tight.

4. The bottle set forth in claim 1, wherein the body further includes: a radially recessed portion extending axially between the radially outwardly facing first surfaces, and including: an insulative portion including the second and third surfaces, and radially outwardly facing fourth surfaces axially between and radially smaller than the first surfaces but radially larger than the second surface and carrying axial margins of the label.

5. A bottle extending along a longitudinal axis and that includes, a base;

a neck; and an insulative body extending axially between the base and the neck, and including:

radially outwardly facing first surfaces spaced axially apart from one another;

a radially outwardly facing second surface radially smaller than, and located axially between, the first surfaces;

a plurality of projections projecting from the second surface and collectively establishing a radially outwardly facing third surface radially larger than the second surface; and parting line bridges projecting radially outwardly from the second surface, diametrically opposed to one another, and extending axially between the first surfaces; and a label carried by the body over at least a portion of the third surface, wherein a continuous insulation volume is established between the label and the second surface, and extends continuously over more than 90 angular degrees around the bottle, wherein the insulation volume extends continuously about 180 angular degrees around the bottle except for the parting line bridges.

6. The bottle set forth in claim 5, wherein the second surface is cylindrical, and the projections are axially and circumferentially spaced apart from one another in an array of straight circumferentially spaced and axially offset columns wherein individual projections of adjacent columns are axially staggered with respect to one another.

7. The bottle set forth in claim 5, wherein the projections are nubs, which are frustoconical and circular when viewed radially, and have a trapezoidal shape in longitudinal cross section.

8. The bottle set forth in claim 7, wherein the nubs include radially outwardly facing faces that are at least one of faceted, crowned, semi-spherical, or part of a surface of revolution 360 angular degrees around the bottle.

9. The bottle set forth in claim 5, wherein the insulation volume is at least 0.020 cubic inches per square inch of corresponding label area.

10. The bottle set forth in claim 5, wherein the at least one radially outwardly facing first surface includes first surfaces spaced axially apart from one another, and wherein the body further includes: a radially recessed portion extending axially between the radially outwardly facing first surfaces, and including: stepped portions extending axially and radially inwardly from the first surfaces, an insulative portion extending axially between the stepped portions, and including the second and third surfaces, and radially outwardly facing fourth surfaces axially between and radially smaller than the first surfaces but radially larger than the second surface, a pair of axially facing shoulders between the first and fourth surfaces, a pair of axially facing shoulders or bevelled portions between the second and fourth surfaces, wherein the third surface is radially smaller than the first surfaces.

11. The bottle set forth in claim 10, wherein the third surface is cylindrical and radially substantially the same size as the fourth surfaces.

12. The bottle set forth in claim 10, wherein the insulation volume extends continuously between the pair of axially facing shoulders or beveled portions.

13. The bottle set forth in claim 5, wherein the projections are axially spaced apart annular ribs to establish annular spaces therebetween.

14. The bottle set forth in claim 13, wherein at least some of the annular ribs include reliefs to establish circumferential spaces between portions of the ribs.

15. The bottle set forth in claim 13, wherein each rib has a semi-spherical outer surface.

16. The bottle set forth in claim 5, wherein the label has axial margins sealed to the bottle so that the continuous insulation volume is air-tight.

17. The bottle set forth in claim 5, wherein surface contact between the label and the third surface is characterized by multiple discrete contact areas such that there is no continuous path of surface contact between the label and third surface 360 angular degrees around the bottle.

18. A bottle extending along a longitudinal axis and that includes, a base;

a neck; and an insulative body extending axially between the base and the neck, and including:

radially outwardly facing first surfaces spaced axially apart from one another;

a radially outwardly facing second surface radially smaller than, and located axially between, the first surfaces;

a plurality of projections projecting from the second surface and collectively establishing a radially outwardly facing third surface radially larger than the second surface; and parting line bridges projecting radially outwardly from the second surface, diametrically opposed to one another, and extending axially between the first surfaces; and a label carried by the body over at least a portion of the third surface, wherein a continuous insulation volume is established between the label and the second surface, and extends continuously over more than 90 angular degrees around the bottle, wherein the label has axial margins sealed to the bottle so that the continuous insulation volume is air-tight.

19. The bottle set forth in claim 18, wherein the insulation volume extends continuously about 180 angular degrees around the bottle except for the parting line bridges.

20. The bottle set forth in claim 18, wherein surface contact between the label and the third surface is characterized by multiple discrete contact areas such that there is no continuous path of surface contact between the label and third surface 360 angular degrees around the bottle.

* * * * *